US005375411A

United States Patent [19]

Aschenbruck et al.

[11] Patent Number: 5,375,411

[45] Date of Patent: Dec. 27, 1994

[54] BYPASS LINE OF A PREMIXING BURNER IN GAS TURBINE COMBUSTION CHAMBERS

[75] Inventors: Emil Aschenbruck, Duisburg; Kurt Bauermeister, Mülheim/Ruhr; Klaus D. Mohr, Wuppertal, all of Germany

[73] Assignee: MAN Gutehoffnungshutte AG, Oberhausen, Germany

[21] Appl. No.: 153,358

[22] Filed: Nov. 16, 1993

[30] Foreign Application Priority Data

Nov. 16, 1992 [DE] Germany ..... 4238602

[51] Int. Cl.[5] ..... F02C 3/14

[52] U.S. Cl. ..... 60/39.23; 60/752

[58] Field of Search ..... 60/39.23, 737, 738, 60/752, 754, 722, 759

[56] References Cited

U.S. PATENT DOCUMENTS

| | | | |
|---|---|---|---|
| 1,733,792 | 10/1929 | Good | 60/39.23 |
| 2,669,090 | 2/1954 | Jackson . | |
| 2,715,816 | 8/1955 | Thorn et al. | 60/39.23 |
| 3,169,367 | 2/1965 | Hussey | 60/754 |
| 3,739,576 | 6/1973 | Chamberlain | 60/738 |

FOREIGN PATENT DOCUMENTS

| | | |
|---|---|---|
| 243557 | 11/1965 | Germany . |
| 2539993A1 | 3/1976 | Germany . |

*Primary Examiner*—Louis J. Casaregola
*Attorney, Agent, or Firm*—McGlew and Tuttle

[57] ABSTRACT

The present invention pertains to a combustion chamber housing of a gas turbine with a laterally arranged inlet elbow (8) for compressor air, which is uniformly distributed over the perforated cone (9) via an intake heart (6), impacts on the injector tube (10) there, and is deflected in the upward direction in the direction of the flame tube and the burner. It is necessary under certain operating conditions of the gas turbine to regulate the primary air flow to the burner, without having to reduce the output of the upstream compressor. This is accomplished according to the present invention by connecting a bypass line (3) with a compensator (1) and a regulating fixture (2), through which part of the air is sent from the air inlet elbow (8) directly into the interior of the injector tube (10) via an inlet tube (4), to the lower part of the combustion chamber.

13 Claims, 2 Drawing Sheets

BYPASS LINE OF A PREMIXING BURNER IN GAS TURBINE COMBUSTION CHAMBERS

BACKGROUND OF THE INVENTION

In the combustion chamber housing according to the German Patent Application P 42 22 391.1, the compressor air flows through a lateral inlet elbow in the shape of an arc into a contracting intake heart and enters the interior of the combustion chamber housing through the perforated cone, flowing in the upward direction there, past the conical injector tube, and reaching the burner and the flame tube there.

The injector tube is attached to the lower part of the flame tube by an intermediate ring, and the flame tube has a refractory lining of ceramic bricks.

The compressor air drawn in from the circular annular channel or intake heart consequently enters the flame tube as primary air through the burner and also enters the inner combustion space of the combustion chamber through secondary air openings in the injector tube. The secondary air openings may be located in both the mixing housing and the flame tube.

According to another combustion chamber housing design, the intake cross section of these secondary air openings in the flame tube can be regulated by means of an adjusting ring, and the secondary airflow cross sections are modified by rotating the adjusting ring with an electromechanical or hydraulic device.

The primary air excess ratio λ of the burner shall be maintained at a nearly constant value for a predetermined work or performance range by adjusting the adjusting ring.

The movable parts of the adjusting ring are located in the compressor air flow between the combustion chamber housing and the flame tube, and the drive unit is located outside the combustion chamber housing.

The space requirement for the arrangement of the adjusting ring within the compressor air flow between the flame tube and the combustion chamber housing is so large that the design of the combustion chamber housing must be modified in this area. It also becomes necessary to have an expensive and complicated sealing of the drive in the wall of the combustion chamber housing.

Finally, the free flow cross section is reduced by the built-in parts of the adjusting ring, and considerable flow losses develop. In addition, high requirements are imposed on the mechanical processing of the moving parts.

SUMMARY AND OBJECTS OF THE INVENTION

The object of the present invention is to expand the operating range of a premixing burner such that part of the compressor air is branched off as tertiary air and is sent directly into the injector tube, without the need to reduce the output of the compressor for generating the compressor air, and such that the disadvantages of the reduction of the amount of air corresponding to the state of the art are eliminated.

Under certain operating conditions, only part of the compressor air is fed into the burner with the device according to the present invention, and this part enters the lower conical part of the combustion chamber housing and the perforated cone, via an approximately circular intake heart in an arc-shaped pattern through a lateral inlet elbow. The compressor air flows in the upward direction between the injector tube and the perforated cone and enters the interior of the flame tube via a series of secondary air openings and via the burner.

The amount of primary air for the burner is reduced by branching off part of the amount of the compressor air and feeding it directly into the injector tube, without reducing the output of the upstream compressor for generating the compressor air, so that this amount of air is not available to the burner, as a result of which the air excess ratio λ is reduced.

A connection piece, to which the flange of a bypass line is attached by means of detachable connection elements, is welded for this purpose into the lateral inlet elbow. This bypass line is led around the combustion chamber outside the intake heart, and is attached in the exemplary embodiment to a second connection piece, which is welded into the intake heart, directly opposite the inlet elbow, by means of detachable connection elements. The circumferential position for the second connection piece is freely selectable.

This part of the compressor air directly enters the lower part of the conical injector robe via an inlet tube mounted on this connection piece. The inlet tube is led into the conical injector tube through the intake heart and through the conical perforated cone.

A compensator and a regulating fixture, e.g., a regulating valve, slide valve, ball valve, etc., is built in the bypass tube.

The bypass tube is composed of commercially available tube sections, elbows, flanges, and connection elements.

One exemplary embodiment of the present invention will be explained on the basis of schematic drawings.

In the drawings,

FIG. 1 shows a top view of the lower part of the combustion chamber housing; and FIG. 2 shows a cross section through the lower part of the combustion chamber housing.

DETAILED DESCRIPTION OF THE PREFERRED EMBODIMENT

Figure 1:
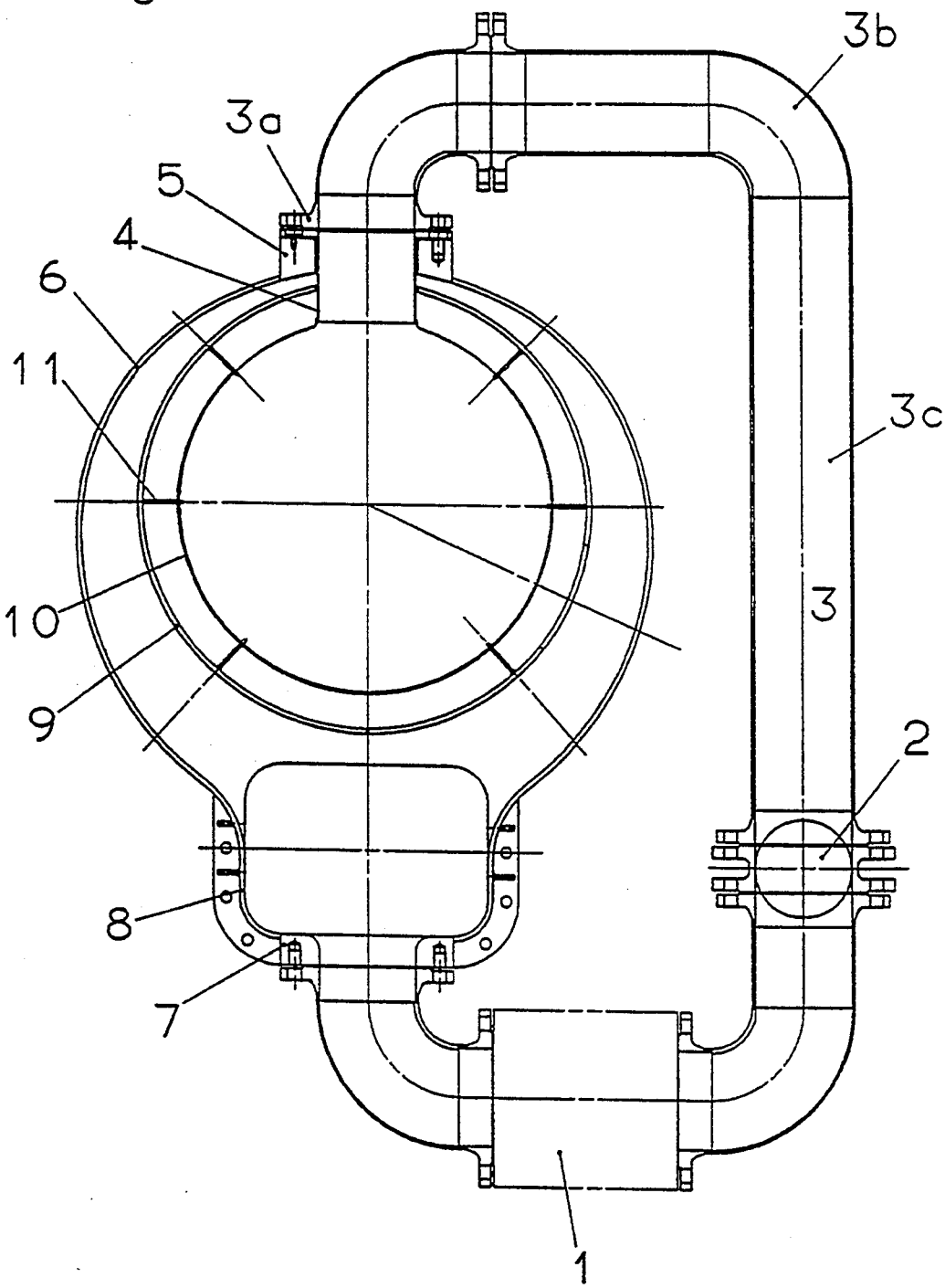

FIG. 1 shows a top view of the lower part of the combustion chamber housing with the bypass line 3 according to the present invention for branching off compressor air. The combustion chamber housing consists of a laterally arranged air inlet elbow 8, which passes over into a horizontally extending, nearly circular intake heart or symmetrical double intake volute 6. The compressor air flows from the intake heart 6 through the perforated cone 9 and into the interior of the combustion chamber, which is divided by ribs 11. The compressor air partially impacts on the injector tube 10, and is deflected there in the upward direction, which is in the direction of the flame tube, not shown, and of the burner. The intake heart 6 is formed by an annular wall, also indicated by 6 in the drawings, which surrounds the narrow end of the perforated cone 9. The annular wall 6 is radially spaced from the narrow end of the perforated cone 9 to define an annular chamber through which the compressor air flows around the perforated cone 9.

The bypass line 3 is connected on one side to an inlet connection piece 7 at the air inlet elbow 8 and on the opposite side to a heart connection piece 5 at the intake heart 6. These connections are made by means of detachable connection elements. The bypass line 3 can contain several elbows 3*b* and a straight length 3*c* to guide the air around the intake heart 6.

The inlet tube 4 is also fastened between a tube flange 3*a* and the connection piece 5, and is then led through the intake heart 6 and the perforated cone 9 into the injector tube 10. A compensator 1 is built in the bypass tube 3 to compensate for the expansion, and a shutoff fixture 2 is built in to regulate the volume flow.

Figure 2:
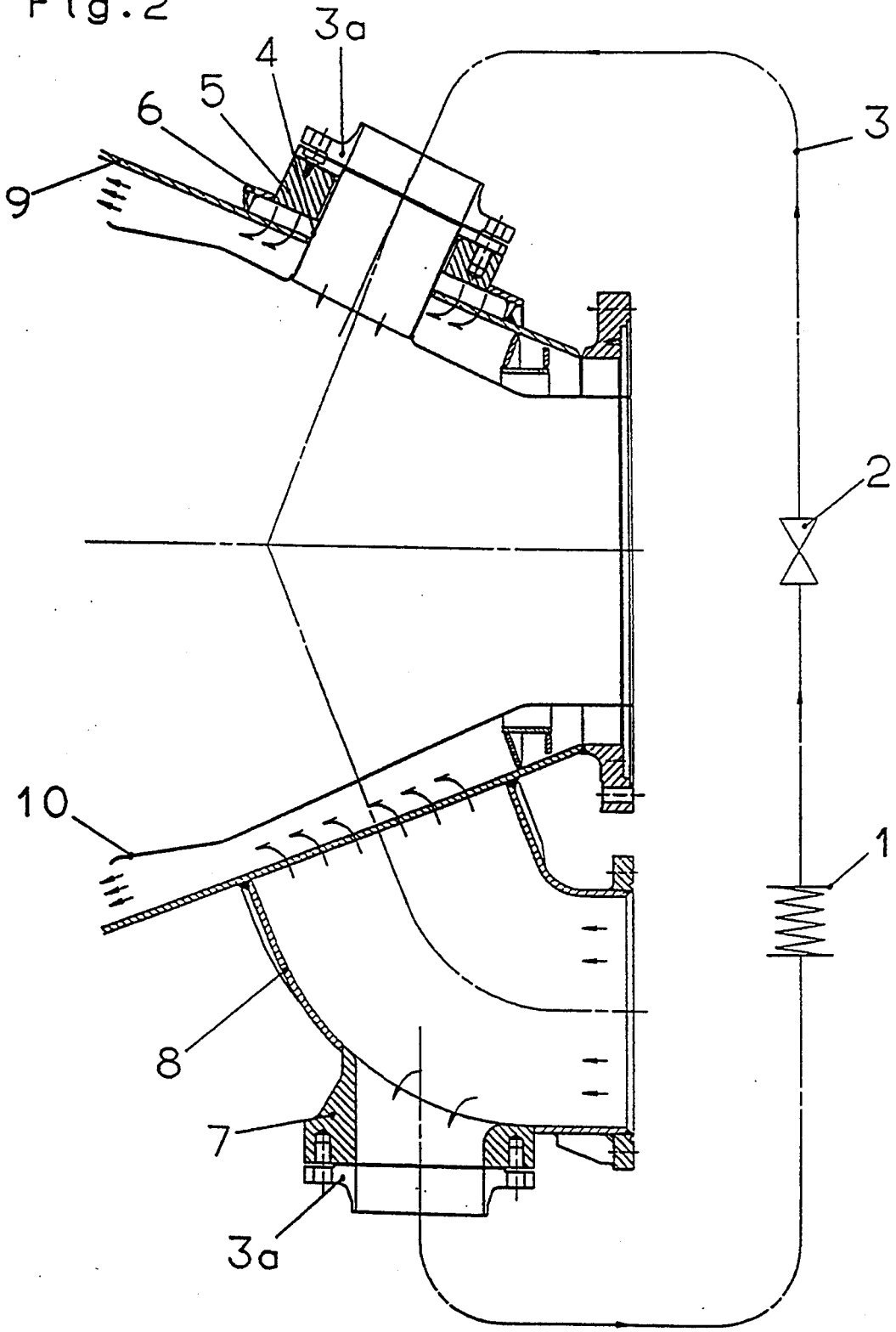

FIG. 2 shows a cross section through the lower part of the combustion chamber, wherein the bypass tube 3, the compensator 1, and the regulating fixture 2 are represented only symbolically.

The arrows shown indicate the different directions of flow of the compressor air. Part of the air flows between the perforated cone 9 and the injector tube 10 in the upward direction in the direction of the flame tube (not shown) and the burner. Another part of the compressor air flows via the bypass line 3 through the inlet tube 4 and directly into the interior of the injector tube 10.

What is claimed is:

1. A gas turbine combustion chamber housing comprising:

an injector tube;

a perforated cone defining perforations on one end and positioned substantially coaxial with and outside said injector tube;

an intake heart means surrounding said one end of said perforated cone and for guiding compressed gas from said intake heart means through said perforations of said perforated cone and in between said perforated cone and said injector tube;

inlet means connected to said intake heart means and for supplying the compressed gas to said intake heart means;

bypass means connected to said inlet means on one end and to said injector tube on another end, said bypass means drawing off a portion of the compressed gas from the inlet means and feeding said drawn off portion into said injector tube.

2. A gas turbine combustion chamber housing in accordance with claim 1, wherein:

said inlet means includes an inlet connection piece;

said intake heart means includes a heart connection piece connecting said intake heart means to said bypass means:

said bypass means includes a bypass tube with a first flange connected to said inlet connection piece and said bypass tube also includes a second flange connected to said heart connection piece, said bypass means also includes an inlet tube connected to said second flange and to said heart connection piece, said inlet tube leading through said intake heart means, said perforated cone, said injector tube and into an inside of said injector tube.

3. A gas turbine combustion chamber housing in accordance with claim 1, wherein:

said inlet means feeds the compressed gas to an inlet side of said intake heart means, and said bypass means feeds the portion of the compressed gas to a side of said injector tube substantially radially opposite from said inlet side of said intake heart means.

4. A gas turbine combustion chamber housing in accordance with claim 1, wherein:

said bypass means includes a compensator means for compensating for expansion and a shut-off fixture.

5. A method for premixing compressed gas in gas turbine combustion chamber housing, the method comprising the steps of:

providing an injector tube;

providing a perforated cone defining perforations on one end and positioned substantially coaxial with and outside said injector tube;

providing an intake heart surrounding said one end of said perforated cone;

providing an inlet elbow connected to said intake heart;

supplying compressed gas to said inlet elbow and into said intake heart;

guiding the compressed gas through said intake heart, through said perforations of said perforated cone and in between said perforated cone and said injector tube;

drawing off a portion of the compressed gas from the inlet elbow and feeding said draw off portion into said injector tube.

6. A method in accordance with claim 5, further comprising the step of:

varying a flow of said drawn off portion of the compressed gas.

7. A method in accordance with claim 5, further comprising the step of:

guiding the compressed gas from said perforations in an axial direction between said perforated cone and said injector tube.

8. A method in accordance with claim 5, wherein:

said one end of said perforated cone is a narrow end and said guiding of said the compressed gas is performed towards a wide end of said perforated cone.

9. A gas turbine combustion chamber housing in accordance with claim 1, wherein:

said injector tube and said perforated cone guide the compressed gas from said perforations in an axial direction between said perforated cone and said injector tube.

10. A gas turbine combustion chamber housing in accordance with claim 1, wherein:

said one end of said perforated cone is a narrow end.

11. A gas turbine combustion chamber housing comprising:

a perforated cone defining perforations on one end;

inlet means for supplying compressed gas;

an annular wall connected to said inlet means and surrounding said one end of said perforated cone, said annular wall guiding compressed gas from said inlet means around said one end of said perforated cone and through said perforations of said perforated cone;

an injector tube positioned substantially coaxial with and inside said perforated cone, said injector tube and said perforated cone guiding the compressed gas from said perforations in an axial direction between said perforated cone and said injector tube;

bypass means connected to said inlet means on one end and to said injector tube on another end, said bypass means drawing off a portion of the compressed gas from the inlet means and feeding said drawn off portion into said injector tube.

12. A gas turbine combustion chamber housing in accordance with claim 11, wherein:

said injector tube has an end positioned radially opposite said one end of said perforated cone defining said perforations and radially opposite said annular wall.

13. A gas turbine combustion chamber housing in accordance with claim 11, wherein:

said one end of said perforated cone is a narrow end.

* * * * *